US008859178B2

(12) United States Patent
Kawamura et al.

(10) Patent No.: US 8,859,178 B2
(45) **Date of Patent: *Oct. 14, 2014**

(54) TONER FOR ELECTROSTATIC IMAGE DEVELOPMENT

(71) Applicants: Takaki Kawamura, Tokyo (JP); Kouji Sugama, Tokyo (JP); Hiroyuki Konno, Tokyo (JP); Hiroshi Nagasawa, Tokyo (JP)

(72) Inventors: Takaki Kawamura, Tokyo (JP); Kouji Sugama, Tokyo (JP); Hiroyuki Konno, Tokyo (JP); Hiroshi Nagasawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/765,000

(22) Filed: Feb. 12, 2013

(65) Prior Publication Data

US 2013/0209930 A1 Aug. 15, 2013

(30) Foreign Application Priority Data

Feb. 13, 2012 (JP) ..... 2012-028145

(51) Int. Cl.
*G03G 9/087* (2006.01)

(52) U.S. Cl.
CPC ..... *G03G 9/08724* (2013.01); *G03G 9/08797* (2013.01); *G03G 9/08782* (2013.01); *G03G 9/08795* (2013.01)
USPC ..... 430/109.3

(58) Field of Classification Search
USPC ..... 430/109.3
See application file for complete search history.

(56) References Cited

U.S. PATENT DOCUMENTS

| | | | | |
|---|---|---|---|---|
| 4,857,433 | A * | 8/1989 | Shin et al. | 430/123.5 |
| 5,217,836 | A * | 6/1993 | Takiguchi et al. | 430/109.3 |
| 6,783,909 | B2 * | 8/2004 | Kawanishi et al. | 430/108.8 |
| 6,846,603 | B2 * | 1/2005 | Fujii et al. | 430/108.4 |
| 7,435,523 | B2 * | 10/2008 | Olson et al. | 430/137.14 |
| 2009/0061334 | A1 * | 3/2009 | Shin et al. | 430/48 |

FOREIGN PATENT DOCUMENTS

| | | |
|---|---|---|
| JP | 08-292601 | 11/1996 |
| JP | 10-133420 | 5/1998 |

OTHER PUBLICATIONS

Aldrich Catalog Handbook of Fine Chemicals, Aldrich Company, 1998-1999, p. 1366.*

* cited by examiner

*Primary Examiner* — Janis L Dote
(74) *Attorney, Agent, or Firm* — Lucas & Mercanti, LLP

(57) ABSTRACT

A toner for electrostatic image development includes toner particles containing a releasing agent and a binder resin, the binder resin containing a copolymer including a structural unit derived from a monomer represented by the general, formula (1), in which $R^1$ represents a hydrogen atom or a methyl group, and $R^2$ represents a hydrogen atom, an alkyl group having 1 to 16 carbon atoms, or an aryl group having 6 to 15 carbon atoms, m is an integer of 2 or 3, and n is an integer of 1 to 8.

general formula (1)

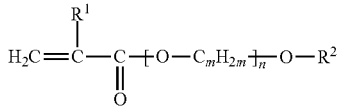

11 Claims, No Drawings

TONER FOR ELECTROSTATIC IMAGE DEVELOPMENT

CROSS REFERENCE TO RELATED APPLICATION

This application claims the priority of Japanese Patent Application Note 2012-028145 filed on Feb. 13, 2012, and which is incorporated by reference herein.

TECHNICAL FIELD

The present invention relates to a toner for electrostatic image development, which is used in image formation of an electrophotographic system.

BACKGROUND ART

There is a need for electrophotographic image forming apparatuses with high energy efficiency and low running costs. Therefore, the development of apparatuses in which fixing temperature is set to be low is being actively performed.

Low temperature fixable toners for electrostatic image development that are usable for such apparatuses (hereinafter simply referred to also as "toners") have some practical problems. More specifically, one problem when a low-temperature fixable toner is used for an image forming apparatus for high-speed mass printing is that, if fusion of the toner during fixation advances to the extent that its viscosity decreases significantly, a hot offset phenomenon occurs in which part of the fused toner is transferred to a fixing member, causing image contamination. Another problem is that the post-fixing separability of the toner from the fixing member is reduced and this causes an image supporting material together with the toner to be wound around the fixing member.

To achieve both low-temperature fixability and hot offset resistance simultaneously, studies focused on binder resins making up toners are being performed, and various proposals have been made.

For example, Patent Literature 1 describes that in order to achieve both the low-temperature fixability and the hot offset resistance simultaneously, ethylene glycol dimethacrylate serving as a cross-linking agent together with a binder resin is added to a toner to facilitate a cross-linking reaction.

However, when the cross-linking agent is added to the toner, the resin becomes hard due to the cross-linking effect, so that sufficient low-temperature fixability cannot be obtained with the above toner.

For example, Patent Literature 2 describes that in order to achieve both the post-fixing separability and the hot offset resistance simultaneously without using a releasing agent, a binder resin and polyethylene glycol methacrylate or acrylate (n=12 to 45) are added to a toner.

However, when the above monomer is added to the toner, a significant reduction in glass transition point occurs, and sufficient hot offset resistance cannot be obtained with the above toner. In addition, since no releasing agent is added, sufficient post-fixing separability cannot also be obtained with the above toner.

CITATION LIST

Patent Literature

Patent Literature 1: Japanese Patent Application Laid-Open No. Hei. 10-133420

Patent Literature 2: Japanese Patent Application Laid-Open No. Hei. 8-292601

SUMMARY OF INVENTION

Technical Problem

The present invention has been made in view of the foregoing circumstances and has as its object the provision of a toner for electrostatic image development that has excellent low-temperature fixability and also has hot offset resistance and post-fixing separability.

Solution to Problem

To achieve the object, a toner for electrostatic image development reflecting one aspect of the present invention comprises toner particles containing a releasing agent and a binder resin, wherein the binder resin contains a copolymer including a structural unit derived from a monomer represented by the following general formula (1):

general formla (1)

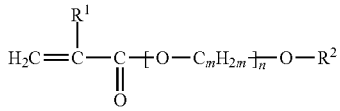

[in the general formula (1), $R^1$ represents a hydrogen atom or a methyl group, $R^2$ represents a hydrogen atom, an alkyl group having 1 to 16 carbon atoms, or an aryl group having 6 to 15 carbon atoms, m is an integer of 2 or 3, and n is an integer of 1 to 8].

In the toner for electrostatic image development of the present invention, n in the general formula (1) may preferably be an integer of 3 to 8.

In the toner for electrostatic image development of the present invention, a content of the monomer represented by the general formula (1) may preferably be 2 to 12% by mass based on a total, mass of monomers forming the copolymer making up the binder resin.

In the toner for electrostatic image development of the present invention, m in the general formula (1) may preferably be an integer of 2.

In the toner for electrostatic image development of the present invention, $R^2$ in the general formula (1) may preferably be a methyl group or a phenyl group.

In the toner for electrostatic image development of the present invention, the copolymer making up the binder resin may preferably be a copolymer of the monomer represented by the general formula (1) and a vinyl-based monomer other than the monomer represented by the general formula (1).

In the toner for electrostatic image development of the present invention, a content of the releasing agent in the toner particles may preferably be 1 to 30% by mass.

In the toner for electrostatic image development of the present invention, the releasing agent may preferably include at least one of a hydrocarbon-based wax and an ester-based wax.

In the toner for electrostatic image development of the present invention, a glass transition point is preferably 30 to 50° C., particularly preferably 35 to 45° C.

In the toner for electrostatic image development of the present invention, a weight average molecular weight (Mw) of the binder resin is preferably 10,000 to 30,000, particularly preferably 20,000 to 30,000.

In the toner for electrostatic image development of the present invention, the releasing agent may preferably be a hydrocarbon-based wax or an ester-based wax.

Advantageous Effects of Invention

In the toner for electrostatic image development of the present invention, the copolymer making up the binder resin in the toner contains the structural unit derived from the monomer represented by the general formula (1). Therefore, the toner can have excellent low-temperature fixability and also have hot offset resistance, and an improved effect of the post-fixing separability of the releasing agent can be obtained.

DESCRIPTION OF EMBODIMENTS

The present invention will next be described in detail.

Toner for Electrostatic Image Development:

The toner of the present invention comprises toner particles containing a releasing agent and a binder resin and optionally containing internal additives such as a colorant and a charge control agent. The toner particles may further contain external additives. In the present invention, the binder resin making up the toner contains a copolymer including a structural unit derived from a monomer represented by the general formula (1) above (this copolymer is hereinafter referred to as a "specific copolymer").

Binder Resin:

The binder resin making up the toner of the present invention may contain an additional resin so long as the binder resin contains the specific copolymer.

Specific Copolymer:

The specific copolymer making up the binder resin contains the structural unit derived from the monomer represented by the general formula (1) above.

In the present invention, the binder resin contains the specific copolymer including the structural unit derived from the monomer represented by the general formula (1). The monomer represented by the general formula (1) and forming the specific copolymer is a monofunctional monomer having an ethylene glycol chain or a propylene glycol chain. The monofunctional ethylene (or propylene) glycol chain forms a domain structure in the binder resin due to the difference in polarity between the ethylene (or propylene) glycol chain and other units. Since the ethylene (or propylene) glycol chain has a glass transition point lower than the glass transition point of the binder resin as a whole, the ethylene (or propylene) glycol chain melts first during heat fixing, and the domain structure partially exhibits a plasticizing effect. This may be the reason that the toner of the invention has excellent low-temperature fixability. However, a bifunctional ethylene (or propylene) glycol chain is anchored by cross links at its opposite ends and therefore cannot form a domain structure, and the plasticizing effect may not be obtained.

Since the monomer includes the ethylene (or propylene) glycol chain derived from polyethylene (or polypropylene) glycol mainly used as a releasing agent, the effect of releasing the toner from a fixing member is obtained. In addition, hot offset resistance and post-fixing separability are obtained. The toner of the present invention also contains the releasing agent, and therefore the effects of hot offset resistance and post-fixing separability are obtained more reliably.

In the general formula (1), $R^1$ represents a hydrogen atom or a methyl group.

$R^2$ is a hydrogen atom, an alkyl group having 1 to 16 carbon atoms, or an aryl group having 6 to 15 carbon atoms. The number of carbon atoms in $R^2$ is preferably equal to or less than the number of carbon atoms in the ethylene (or propylene) glycol chain because the domain structure is easily formed. More specifically, when m is 2 and n is 3, the number of carbon atoms in $R^2$ is preferably 6 or less. Particularly, $R^2$ is preferably a methyl group or a phenyl group.

m is an integer of 2 or 3. The smaller m, the lower the glass transition point, and the higher the plasticizing effect after the formation of the domain structure. Therefore, m is preferably 2.

n is an integer of 1 to 8, more preferably 3 to 8. If n is equal to or larger than 9, the plasticizing effect becomes excessively high, and the hot offset resistance and the post-fixing separability decrease. When n is 1 or 2, the effects of the present invention can be obtained. However, to obtain a higher plasticizing effect, n is preferably 3 to 8.

Specific examples of the monomer represented by the general formula (1) include polyethylene glycol methacrylates (n=1 to 8, $R^1$=a methyl group, and $R^2$=a hydrogen atom), polyethylene glycol acrylates (n=1 to 8, $R^1$=a hydrogen atom, and $R^2$=a hydrogen atom), methoxy polyethylene glycol methacrylates (n=1 to 8, $R^1$=a methyl group, and $R^2$=a methyl group), methoxy polyethylene glycol acrylates (n=1 to 8, $R^1$=a hydrogen atom, and $R^2$=a methyl group), phenoxy polyethylene glycol methacrylates (n=1 to 8, $R^1$=a methyl group, and $R^2$=a phenyl group), phenoxy polyethylene glycol acrylates (n=1 to 8, $R^1$=a hydrogen atom, and $R^2$=a phenyl group), lauroxy polyethylene glycol methacrylates (n=1 to 8, $R^1$=a methyl group, and $R^2$=$C_{12}H_{25}$), lauroxy polyethylene glycol acrylates (n=1 to 8, $R^1$=a hydrogen atom, and $R^2$=$C_{12}H_{25}$), and nonylphenoxy polyethylene glycol acrylates (n=1 to 8, $R^1$=a methyl group, and $R^2$=$C_{15}H_{25}$). The monomer represented by the general formula (1) may also be a compound in which the ethylene moieties of any of the above monomers are substituted with propylene.

The content of the monomer represented by the general formula (1) is preferably 2 to 12% by mass, more preferably 3 to 8% by mass based on the total mass of monomers forming the specific copolymer.

When the content of the monomer represented by the general formula (1) is within the above range, a higher plasticizing effect and a higher releasing effect are obtained.

If the content of the monomer represented by the general formula (1) is excessively large, the glass transition point of the binder resin itself may be lowered, and sufficient heat-resistant storage stability may not be obtained. If the content of the monomer represented by the general formula (1) is excessively low, the plasticizing and releasing effects of the ethylene (or propylene) glycol chain may not be obtained sufficiently, and sufficient low-temperature fixability and post-fixing separability may not be obtained.

The specific copolymer making up the binder resin is formed of the monomer represented by the general formula (1) and another monomer, and no particular limitation is imposed on the another monomer so long as it is copolymerizable with the monomer represented by the general formula (1). The another monomer is preferably a vinyl-based monomer other than the monomer represented by the general formula (1). Examples of the another monomer include:

(1) styrene and derivatives thereof such as styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and derivatives thereof (of these, styrene is preferred);

(2) methacrylates and derivatives thereof such as methyl methacrylate (MMA), ethyl methacrylate (EMA), n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, and derivatives thereof;

(3) acrylates and derivatives thereof such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and derivatives thereof (of these, n-butyl acrylate is preferred);

(4) olefins such as ethylene, propylene, and isobutylene;

(5) vinyl esters such as vinyl propionate, vinyl acetate, and vinyl benzoate;

(6) vinyl ethers such as vinyl methyl ether and vinyl ethyl ether;

(7) vinyl ketones such as vinyl methyl ketone, vinyl ethyl ketone, and vinyl hexyl ketone;

(8) N-vinyl compounds such as N-vinylcarbazole, N-vinylindole, and N-vinylpyrrolidone; and (9) other compounds such as vinyl compounds (for example, vinylnaphthalene and vinylpyridine) and derivatives of acrylic acid and methacrylic acid such as acrylonitrile, methacrylonitrile, and acrylamide.

These monomers may be used either singly or in any combination thereof.

A monomer having an ionic leaving group other than a carboxyl group, such as a sulfonic acid group or a phosphoric acid group, may also be used as the another monomer copolymerizable with the monomer represented by the general formula (1).

Specific examples of such a monomer having an ionic leaving group include: styrene sulfonic acid, allylsulfo succinic acid, 2-acrylamide-2-methylpropane sulfonic acid, acid phosphoxyethyl methacrylate, and 3-chloro-2-acid phosphoxypropyl methacrylate.

The binder resin making up the toner of the present invention may contain an additional resin together with the specific copolymer. Preferred examples of the additional resin include styrene-acrylic-based resins and polyester resins. In addition, any of olefin-based resins such as vinyl-based resins, polyamide-based resins, carbonate resins, polyether, polyvinyl acetate-based resins, polysulfone, epoxy resins, polyurethane resins, and urea resins may also be used. These may be used either singly or in any combination thereof.

Preferably, the additional resin may be added to the binder resin in an amount of 0 to 80% by mass.

The glass transition point of the binder resin making up the toner of the present invention is preferably 30 to 50° C., more preferably 35 to 48° C.

When the glass transition point of the binder resin is within the above range, low-temperature fixability is reliably obtained.

If the glass transition point of the binder resin is higher than 50° C., sufficient low-temperature fixability may not be obtained. If the glass transition point of the binder resin is lower than 30° C., sufficient post-fixing separability may not be obtained.

In the present invention, the glass transition point of the binder resin is measured using a "DIAMOND DSC" (manufactured by PerkinElmrer Co., Ltd.)

The procedure of the measurement is as follows. 3.0 mg of a sample (the binder resin) is sealed in an aluminum-made pan, and the pan is placed in a holder. An empty aluminum-made pan is used as a reference. A heating-cooling-heating cycle is performed in the measurement temperature range of 0° C. to 20° C. under the measurement conditions of a temperature increase rate of 10° C./min and a temperature decrease rate of 10° C./min. Analysis is performed using data in the 2nd heating, and the intersection of the extension of a base line before the rising edge of a first endothermic peak and a tangential line representing the maximum inclination between the rising edge of the first endothermic peak and the top of the peak is used as the glass transition point.

The weight average molecular weight (Mw) of the binder resin making up the toner of the present invention is preferably 10,000 to 30,000, more preferably 20,000 to 30,000.

When the weight average molecular weight (Mw) of the binder resin is within the above range, low-temperature fixability and post-fixing separability are reliably obtained.

If the weight average molecular weight (Mw) of the binder resin is excessively large, sufficient low-temperature fixability may not be obtained. If the weight average molecular weight (Mw) of the binder resin is excessively low, sufficient post-fixing separability may not be obtained.

In the present invention, the weight average molecular weight (Mw) of the binder resin is measured by gel permeation chromatography (GPC).

More specifically, the weight average molecular weight is measured using an apparatus "HLC-8220" (manufactured by TOSOH Corporation) and a column "TSKguardcolumn+ TSKgel SuperHZM-M (three in series)" (manufactured by TOSOH Corporation) in the flow of tetrahydrofuran (THF) used as a carrier solvent at a flow rate of 0.2 mL/min while the temperature of the column is held at 40° C. A sample (binder resin) is dissolved in THF at a concentration of 1 mg/mL using an ultrasonic disperser. In this case, the dissolving treatment is performed at room temperature for 5 minutes. Next, the obtained solution is treated through a membrane filter having a pore size of 0.2 μm to obtain a sample solution, and 10 μL of the sample solution together with the above-described carrier solvent injected into the apparatus. Detection is performed using a refractive index detector (RI detector), and the molecular weight distribution of the sample is computed using a calibration curve determined using monodispersed polystyrene standard particles. Ten different types of polystyrene were used for the determination of the calibration curve.

Releasing Agent:

No particular limitation is imposed on the releasing agent making up the toner of the present invention. Examples of the releasing agent include polyolefin waxes such as polyethylene wax and polypropylene wax; branched chain hydrocarbon-based waxes such as microcrystalline wax; long chain hydrocarbon-based waxes such as paraffin wax and Sasol wax; dialkyl ketone-based waxes such as distearyl ketone; ester-based waxes such as carnauba wax, montan wax, behenyl behenate, trimethyloloropane tribehenate, pentaerythritol tetrabehenate, pentaerythritol diacetate dibehenate, glycerin tribehenate, 1,18-octadecanediol distearate, tristearyl trimellitate, and distearyl maleate; and amide-based waxes such as ethylenediamine dibehenylamide and tristearyl trimellitate amide. These may be used either singly or in any combination thereof.

Of these, at least one of hydrocarbon-based waxes and ester-based waxes is preferred from the viewpoint of their sharp melting properties.

The melting point of the releasing agent is generally 40 to 160° C., preferably 50 to 120°, more preferably 60 to 90° C. When a releasing agent having a melting point within the above range is used, the toner to be obtained has heat-resistant storage stability with reliability, and stable low-temperature fixability is obtained.

The releasing agent is added to the toner particles in an amount of preferably 1 to 30% by mass, more preferably 5 to 20% by mass.

When the content of the releasing agent is within the above range, sufficient post-fixing separability is obtained.

If the content of the releasing agent is excessively large, the binder resin becomes excessively soft, and therefore the heat-resistant storage stability of the toner may deteriorate.

Colorant:

The colorant used may be any of the commonly known dyes and pigments.

As a colorant used to obtain a black toner, any of various publicly known colorants such as carbon blacks (for example, furnace black and channel black), magnetic substances (for example, magnetite and ferrite), dyes, and inorganic pigments containing nonmagnetic iron oxide may be used.

As a colorant used to obtain a color toner, any of the publicly known colorants such as dyes and organic pigments may be used. Specific examples of the organic pigments include C.I. Pigment Red: 5, 48:1, 53:1, 57:1, 81:4, 122, 139, 144, 149, 166, 177, 173, 222, 238, and 269, C.I. Pigment Yellow: 14, 17, 74, 93, 94, 138, 155, 180, and 185, C.I. Pigment Orange: 31 and 43, and C.I. Pigment Blue: 15:3, 60, and 76. Specific examples of the dyes include C.I. Solvent Red: 1, 49, 52, 58, 68, 11, and 122, C.I. Solvent Yellow 19, 44, 77, 79, 81, 82, 93, 98, 103, 104, 112, and 162, and C.I. Solvent Blue 25, 36, 69, 70, 93, and 95.

One colorant or a combination of two or more colorants may be used for a toner of each color.

The content of the colorant in the toner particles is preferably 1 to 10% by mass, more preferably 2 to 8% by mass.

Charge Control Agent:

Any of various publicly known compounds can be used as the charge control agent.

The content of the charge control agent in the toner particles is preferably 0.1 to 10% by mass, more preferably 0.5 to 5% by mass.

Average Particle Diameter of Toner:

The average particle diameter of the toner of the invention is preferably 3 to 9 μm, for example, as a volume-based median diameter, more preferably 3 to 8 μm. When the toner is produced using, for example, an emulsion polymerization association method described later, the particle diameter can be controlled by changing the concentration of an aggregating agent used, the amount added of an organic solvent, the fusion-bonding time, and the composition of the polymer.

When the volume-based median diameter of the toner is within the above range, high transfer efficiency is achieved, and the quality of a halftone image is improved. In addition, the image quality of fine lines and dots is improved.

In the present invention, the volume-based median diameter of the toner is measured and computed using a measuring device composed of a particle sizing and counting analyzer "MULTISIZER 3" (manufactured by Beckman Coulter, Inc.) and a computer system connected thereto and equipped with data processing software "Software V3.51."

Specifically, 0.02 g of the sample (the toner) is added to 20 mL of a surfactant solution (a surfactant solution used for the purpose of dispersing the toner particles and obtained, for example, by diluting a neutral detergent containing a surfactant component ten-fold with pure water) and is caused to be intimate, and then ultrasonic dispersion is performed for 1 minute to prepare a dispersion of the toner. This toner dispersion is added with a pipette to a beaker held in a sample stand and containing a diluent "ISOTON II" (manufactured by Beckman Coulter, Inc.) until the concentration displayed on the measuring device reaches 8%. By using the above concentration range a reproducible measurement value can be obtained. In the measuring device, the number of particles to be counted is set to 25,000, and the diameter of an aperture is set to 50 μm. The range of measurement (1 to 30 μm) is divided, into 256 sections, and a frequency value in each section is computed. The particle size when a cumulative volume fraction cumulated from the largest volume fraction is 50% is used as the volume-based median diameter.

Average Circularity of Toner:

From the viewpoint of conversion efficiency, the average circularity of the toner of the present invention is preferably 0.930 to 1.000, more preferably 0.950 to 0.995.

In the present invention, the average circularity of the toner is measured using a flow-type particle image analyzer "FPIA-2100" (manufacture by Sysmex Corporation).

More specifically, the sample (the toner) is caused to be intimate in a surfactant-containing aqueous solution and then subjected to ultrasonic dispersion treatment for 1 minute to disperse the toner Then images of the toner are taken using the flow-type particle image analyzer "FPIA-2100" (manufacture Sysmex Corporation) in an HPF (high-power field) measurement mode at an appropriate concentration (the number of particles detected in the HPF mode: 3,000 to 10,000). The circularities of the particles are computed using the following formula (T) and summed up, and the total is divided by the total number of toner particles to compute the average circularity.

circularity=(perimeter of circle having the same area as the particle image)/(perimeter of projected particle image) Formula (T):

Glass Transition Point and Softening Point of Toner:

The glass transition point of the toner of the present invention is preferably 30 to 50° C., more preferably 35 to 45° C.

The softening point of the toner is preferably 80 to 120° C., more preferably 90 to 110° C.

In the present invention, the glass transition point (Tg) of the toner is measured by the same method as described above using the toner as the measurement sample.

In the present invention, the softening point of the toner is measured as follows.

First, 1.1 g of the sample (the toner) is placed in a petri dish in an environment of a temperature of 20±1° C. and a relative humidity of 50±5% RH and then is leveled off. After left to stand for 12 hours or longer, the sample is pressurized using a press "SSP-10A" (manufactured by Shimadzu Corporation) at a pressure of 3,820 kg/cm$^2$ for 30 seconds to produce a cylindrical molded sample having a diameter of 1 cm. Then the molded sample is placed in a flow tester "CFT-500D" (manufactured by Shimadzu Corporation) in an environment of a temperature of 24±5° C. and a relative humidity of 50±20% RH. Under the conditions of a load of 196 N (20 kgf), a start temperature of 60° C., a preheating time of 300 seconds, and a temperature increase rate of 6° C./min, the molded sample is extruded from the hole (1 mm diameter×1 mm) of a cylindrical die using a piston having a diameter of 1 cm after completion of preheating. An offset temperature $T_{offset}$ measured by a melting point measurement method (temperature rise method) at an offset value setting of 5 mm is used as the softening point.

Production Process of Toner:

No particular limitation is imposed on a production process of the toner of the present invention, and examples of the production process include publicly Known processes such as a kneading-pulverizing process, a suspension polymerization process, an emulsion aggregation process, a dissolution suspension process, a polyester extension process, and a dispersion polymerization process.

Of these, the emulsion aggregation process is used preferably from the viewpoint of shape controllability, the ease of forming a core-shell structure, and uniformity of the diameter of particles which is advantageous for high image quality and high stability.

With the emulsion aggregation process, toner particles are produced by preparing a dispersion of fine binder resin particles (hereinafter also referred to as "fine resin particles") dispersed using a surfactant or a dispersion stabilizer, optionally mixing the dispersion with a dispersion of a toner particle-forming component such as fine colorant particles, adding an aggregating agent to aggregate the toner particles until the desired diameter is achieved, and fusing the fine resin particles during or after aggregation to control the shape of the particles.

The fine resin particles may optionally contain internal additives such as a charge control agent or may be composite particles including a plurality of layers, i.e., two or more layers formed of different resins with different compositions. Alternatively, the internal additives may be introduced into the toner particles by separately preparing a dispersion of fine internal additive particles composed only of the internal additives and aggregating the fine internal additive particles together with the fine resin particles and the fine colorant particles in an aggregation-fusion step.

The releasing agent making up the toner of the present invention may be introduced into the toner particles by preparing a fine releasing agent particle dispersion composed only of the releasing agent and then aggregating the fine releasing agent particles together with the fine resin particles and the fine colorant particles in the aggregation-fusion step. When composite particles are used, the monomer represented by the general formula (1) may be added to any layer.

From the viewpoint of the design of the structure of the toner, it is preferable to add different types of fine resin particles during aggregation to form toner particles having the core-shell structure.

The fine resin particles may be produced by, for example, an emulsion polymerization process, a miniemulsion polymerization process, or a phase-transfer emulsification process or by a combination of some production processes. When the internal additives are added to the fine resin particles, the miniemulsion polymerization process is particularly preferably used.

A method of introducing the specific copolymer into the toner particles according to the present invention will next be specifically described.

With an emulsion aggregation process, the specific copolymer may be introduced into the fine resin particles to be aggregated. When the fine resin particles are composite particles having two or more layers and formed by a plurality of polymerization reactions, the monomer represented by the general formula (1) may be introduced into any of the layers in the composite particles.

The fine resin particles to be aggregated may include any fine resin particles other than the fine resin particles containing the specific copolymer. The particles containing the specific copolymer may be added during aggregation at any timing between the initial and late stages of the aggregation. The particles containing the specific copolymer may be divided into a plurality of portions and then added separately.

With the kneading-pulverizing process, the specific copolymer alone or the specific copolymer together with the internal additives etc. is added during kneading of the resin.

External Additives:

The toner particles of the present invention can be used as toner particles without any other additives. However, external additives such as publicly known particles (for example, inorganic fine particles or organic fine particles) and a lubricant may be added to the surface of the toner particles, from the viewpoint of improving the charging ability, flowability, or cleanability of the toner.

Preferred examples of the inorganic particles include inorganic fine particles of silica, titania, alumina, and strontium titanate.

These inorganic fine particles may be optionally subjected to hydrophobic treatment.

As the organic fine particles, spherical organic fine particles having a number average primary particle diameter of about 10 to about 2,000 nm can be used. More specifically, organic fine particles of a homopolymer of styrene or methyl methacrylate or a copolymer thereof can be used.

The lubricant is used for the purpose of further improving the cleanability and transfer properties. Examples of the lubricant include metal salts of higher fatty acids such as stearates of zinc, aluminum, copper, magnesium, calcium, etc., oleates of zinc, manganese, iron, copper, magnesium, etc., palmitates of zinc, copper, magnesium, calcium, etc., linoleates of zinc, calcium, etc., and ricinoleates of zinc, calcium, etc. A combination of various materials may be used as the external additives.

The total amount of the external additives is preferably 0.1 to 10.0% by mass based on the mass of the toner particles.

Examples of a method of adding the external additives include an adding method using any of various publicly known mixers such as a turbula mixer, a mixer HENSCHEL MIXER, a nauta mixer, and a V-type mixer.

Developer:

The toner of the present invention can be used as a magnetic or non-magnetic one-component developer or may be mixed with a carrier and used as a two-component developer.

When the toner is used as a two-component developer, the amount of the toner mixed with the carrier is preferably 2 to 10% by mass.

No particular limitation is imposed on a mixer used to mix the toner and the carrier, and examples of the mixer include a nauta mixer and W-cone and V-type mixers.

The carrier has an average particle diameter of preferably 10 to 60 μm as a volume-based median diameter.

In the present invention, the volume-based median diameter of the carrier can be measured by a laser diffraction-type particle size distribution measuring device "HELOS" (manufactured by SYMPATEC) equipped with a wet-type dispersing device as a representative measuring device.

Preferably, the carrier used is a coated carrier obtained by coating the surfaces of magnetic particles (cores) with a resin. No particular limitation is imposed on the resin used to coat the cores, and any of various resins can be used. For example, any of fluorocarbon resins, fluorine-acrylic acid resins, silicone resins, modified silicone resins, etc. can be used for a toner formed for positive electrification, and a condensed-type silicone resin is particularly preferably used. For example, any of styrene-acrylic resins, a resin mixture of a styrene-acrylic resin and a melamine resin, a cured product thereof, silicone resins, modified silicone resins, epoxy resins, polyester resins, urethane resins, polyethylene resins, etc. can be used for a toner formed for negative electrification. Of these, a resin mixture of a styrene-acrylic resin and a melamine resin, a cured product thereof, and a condensed-type silicone resin are preferably used.

When the toner of the present invention is used as a two-component developer, a charge control agent, an adhesion promoter, a primer treatment agent, a resistance controlling agent, etc. may be optionally added to the toner and the carrier to form the two-component developer.

Image Forming Method:

The toner of the present invention can be used for commonly used electrophotographic image forming methods.

In the toner described above, the specific copolymer making up the binder resin of the toner contains the structural unit derived from the monomer represented by the general formula (1). Therefore, the toner has excellent low-temperature fixability and also has hot offset resistance and post-fixing separability.

The embodiments of the present invention have been specifically described. However, the embodiments of the present invention are not limited to the examples described above, and various modifications can be made thereto.

EXAMPLES

Specific Examples of the present invention will next be described, but the invention is not limited thereto.

Toner Production Example 1 (Example 1)

(1) Preparation of Fine Resin Particle Dispersion

A reaction vessel equipped with a stirrer, a temperature sensor, a condenser tube, and a nitrogen introduction tube was charged with 800 parts by mass of ion exchanged water. The reaction vessel was heated to 82° C., and 17 parts by mass of sodium polyoxyethylene (2) dodecyl ether sulfate, 930 parts by mass of ion exchanged water, and a monomer solution containing the following compounds were added to the reaction vessel. The mixture was mixed and dispersed for 1 hour using a mechanical disperser having a circulation path "CLEAMIX" (manufactured by M Technique Co., Ltd.) to prepare a dispersion containing emulsified particles (oil droplets).

| | |
|---|---|
| Styrene (St) | 245 parts by mass |
| n-Butyl acrylate (BA) | 120 parts by mass |
| n-Octyl-3-mercaptan | 1.5 parts by mass |
| Behenyl behenate | 95.6 parts by mass |

Then a polymerization initiator solution prepared by dissolving 6 parts by mass of potassium persulfate in 100 parts by mass of ion exchanged water was added to the obtained dispersion. The resultant dispersion was heated and stirred at a temperature of 82° C. for 1 hour to perform polymerization, and a dispersion of fine resin particles [1 HM] was thereby obtained.

A polymerization initiator solution prepared by dissolving 11 parts by mass of potassium persulfate in 400 parts by mass of ion exchanged water was further added to the dispersion of the fine resin particles [1 HM], and a monomer solution containing the following compounds was added thereto over 1 hour at a temperature of 82° C. After completion of the dropwise addition, the mixture was heated and stirred for 2 hours to perform polymerization and then cooled to 28° C. to prepare a dispersion of fine resin particles [1].

| | |
|---|---|
| Styrene (St) | 400 parts by mass |
| n-Butyle acrylate (BA) | 72 parts by mass |

-continued

| | |
|---|---|
| Methacrylic acid (MAA) | 33 parts by mass |
| Monomer A having a structure shown in TABLE 1 | 52 parts by mass |
| n-Octyl-3-mercaptan | 12 parts by mass |

(2) Preparation of Fine Colorant Particle Dispersion

90 Parts by mass of sodium dodecylsulfate was added to 1,600 parts by mass of ion exchanged water, and 420 parts by mass of carbon black "REGAL 330R" (manufactured by Cabot Corporation) was gradually added to the prepared solution under stirring. Then the mixture was subjected to dispersion treatment using a stirring device "CLEARMIX" (manufactured by M Technique Co., Ltd.) to thereby prepare a dispersion of fine colorant particles [2]. The diameter of the fine colorant particles [1] was measured using an electrophoretic light-scattering photometer "ELS-800" (manufactured by Otsuka Electronics Co., Ltd.) and found to be 110 nm.

(3) Aggregation, Fusion, and Aging

A reaction vessel equipped with a stirrer, a temperature sensor, a condenser tube, and a nitrogen introduction tube was charged with the following materials, and the temperature of the solution was adjusted to 30° C.

| | |
|---|---|
| Ion exchanged water | 1,400 parts by mass |
| Dispersion of fine resin particles [1] | 300 parts by mass (in terms of solid content) |
| Dispersion of fine colorant particles [1] | 120 parts by mass |

Then a 5 mol/L aqueous sodium hydroxide solution was added to the mixture to adjust its pH to 10, and an aqueous solution (30° C.) prepared by dissolving 35 parts by mass of magnesium chloride in 35 parts by mass of ion exchanged water was added to the reaction system over 10 minutes under stirring. Three minutes after the addition, the temperature of the reaction system was increased to 86° C. over 60 minutes to allow aggregation to proceed. The size of the particles formed by aggregation was monitored using a particle sizing and counting analyzer "MULTISIZER 3." When the volume-based medium diameter (D50) reached 6.5 μm, 750 parts by mass of a 20% aqueous sodium chloride solution was added to terminate aggregation.

After the addition of the 20% aqueous sodium chloride solution, stirring was continued while the solution temperature was maintained at 81° C., and fusion bonding of the aggregated particles was allowed to proceed while the average circularity of the particles was monitored using a flow-type particle image analyzer "FPIA-2100." After the average circularity was confirmed to be 0.940, the solution temperature was reduced to 30° C. Then hydrochloric acid was added to adjust the pH to 4.0, and the stirring was stopped.

(4) Washing and Drying

The obtained aggregated particles were subjected to solid-liquid separation using a basket-type centrifuge "MARK III TYPE 60.times.40" (manufactured by Matsumoto Machine Manufacturing Co., Ltd.) to form a wet cake of the toner particles. The wet cake was washed with ion exchanged water (40° C.) in the basket-type centrifuge until the electric conductivity of the filtrate became 5 μS/cm. Then the cake was transferred to is flash dryer "FLASH JET DRYER" (manufactured by Seishin Enterprise Co. Ltd.) and dried until the water content became 0.5% by mass to thereby obtain toner particles [1].

(5) Addition of External Additives

One % by mass of hydrophobic silica (number average primary particle diameter=12 nm) and 0.3% by mass of hydrophobic titania (number average primary particle diameter=20 nm) were added to the above-obtained toner particles [1], and the mixture was mixed in a mixer HENSCHEL MIXER to produce a toner [1].

The volume-based median diameter (D50) of the toner [1] was 6.5 μm, and its average circularity was 0.940.

Toner Production Examples 2 to 13 (Examples 2 to 10 and Comparative Examples 1 to 3)

Toners [2] to [13] were produced as in Toner Production Example 1 except that monomers B to M shown in TABLE 1 were used instead of the monomer A, an amount of the monomer was changed such that a compositional ratio of the monomer and the additional monomer were the compositional ratio shown in TABLE 1, and the releasing agent used in Toner Production Example 1 was changed to a releasing agent shown in TABLE 1.

Toner Production Example 14 (Comparative Example 4)

A toner [14] was produced as in Toner Production Example 2 except that the releasing agent was not added.

Developer Production Examples 1 to 14

Developers [1] to [14] were prepared by mixing the respective toners [1] to [14] with a ferrite carrier having a volume average particle diameter of 50 μm and coated with a silicone resin such that the concentration of the toner in each developer were 6%.

Evaluation 1: Low-Temperature Fixability and Hot Offset Resistance

For each of the developers [1] to [14], a fixing experiment was performed using a copier "bizhub PRO C6500" (manufactured by Konica Minolta Business Technologies, Inc.) including a fixing unit modified such that the surface temperature of a heating roller (fixing temperature) could be changed within the range of 120 to 200° C. In the fixing experiment, a solid image (1.5 cm×1.5 cm) with a toner adhesion amount of 2 mg/cm was fixed on an A4 high-quality paper sheet (basis weight: 64 g/m$^2$) in a room temperature-room humidity environment (temperature: 20° C., humidity: 55% RH). The fixing experiment was repeated at different temperature settings, i.e., the temperature setting was increased to 200° C. in steps of 5° C.

In the results of the fixing experiment in which no image contamination due to low-temperature offset was visually observed, the lowest one of the fixing temperatures obtained by the fixing experiment was evaluated as a minimum fixing temperature. A developer having a minimum fixing temperature of 140° C. or lower was judged as pass.

TABLE 1

| TONER NO. | MONOMER NO. | IN THE GENERAL FORMULA (1) $R^1$ | $R^2$ | m | n | ADDITIONAL MONOMER TYPE | RELEASING AGENT TYPE | COPOLYMER COMPOSITIONAL RATIO (% BY MASS) COPOLYMER A TO M | ADDITIONAL MONOMER | GLASS TRANSITION POINT OF TONER (° C.) |
|---|---|---|---|---|---|---|---|---|---|---|
| 1 | A | H | $CH_3$ | 2 | 2 | St, BA, MAA | BEHENYL BEHENATE | 2.0 | 98.0 | 41 |
| 2 | B | $CH_3$ | $C_6H_5$ | 2 | 5 | St, BA, MAA | BEHENYL BEHENATE | 3.5 | 96.5 | 41 |
| 3 | C | H | $C_6H_5$ | 2 | 1 | St, BA, MAA | BEHENYL BEHENATE | 12.0 | 88.0 | 42 |
| 4 | D | $CH_3$ | $CH_3$ | 2 | 3 | St, BA, MAA | BEHENYL BEHENATE | 5.5 | 94.5 | 41 |
| 5 | E | H | $CH_3$ | 2 | 8 | St, BA, MAA | BEHENYL BEHENATE | 8.0 | 92.0 | 42 |
| 6 | F | H | $CH_3$ | 3 | 3 | St, BA, MAA | BEHENYL BEHENATE | 4.0 | 96.0 | 43 |
| 7 | G | $CH_3$ | $C_6H_5$ | 3 | 5 | St, BA, MAA | BEHENYL BEHENATE | 3.5 | 96.5 | 43 |
| 8 | H | $CH_3$ | $C_{15}H_{23}$ | 2 | 8 | St, BA, MAA | HNP-57 (MANUFACTURED BY NIPPON SEIRO CO., LTD.) | 12.0 | 88.0 | 41 |
| 9 | I | H | $C_{16}H_{33}$ | 2 | 8 | St, BA, MAA | BEHENYL BEHENATE | 5.5 | 94.5 | 40 |
| 10 | J | H | $C_{15}H_{23}$ | 3 | 3 | St, BA, MAA | BEHENYL BEHENATE | 8.0 | 92.0 | 41 |
| 11 | K | H | $CH_3$ | 2 | 9 | St, BA, MAA | BEHENYL BEHENATE | 8.0 | 92.0 | 41 |
| 12 | L | $CH_3$ | $C_6H_5$ | 3 | 23 | St, BA, MAA | BEHENYL BEHENATE | 5.5 | 94.5 | 34 |
| 13 | M | H | ACRYLIC GROUP | 2 | 5 | St, BA, MAA | BEHENYL BEHENATE | 5.5 | 94.5 | 45 |
| 14 | B | $CH_3$ | $C_6H_5$ | 2 | 5 | St, BA, MAA | NONE | 3.5 | 96.5 | 47 |

In the results of the fixing experiment in which image contamination due to hot offset was visually observed, the lowest one of the fixing temperatures obtained by the fixing experiment was evaluated as a hot offset temperature. A developer having a hot offset temperature of 190° C. or higher or causing no hot offset was judged as pass. The "developer causing no hot offset" means that no image contamination due to hot offset was observed even after the fixing experiment at a fixing temperature of 200° C.

The results are shown in TABLE 2.

Evaluation 2: Post-Fixing Separability

For each of the developers [1] to [14], a solid black band-shaped image (toner adhesion amount: 4.5 mg/cm$^2$) having a width of 5 cm and extending in a direction orthogonal to a sheet conveying direction was fixed on a longitudinally conveyed A4 high-quality paper sheet (basis weight: 64 g/m$^2$) using a copier "bizhub PRO C6500" (manufactured by Konica Minolta Business Technologies, Inc.) including a fixing unit with the surface temperature of a heating roller being set to 195° C. The separability of the paper sheet was evaluated according to the following evaluation criteria. The results are shown in TABLE 2.

"A," "B," and "C" are pass grades.

-Evaluation Criteria-

A: The paper sheet was not curled and was separated from the heating roller without contact with a separation claw.

B: The paper sheet was separated from the heating roller by the separation claw, but no marks by the separation claw were formed on the image.

C: The paper sheet was separated from the heating roller by the separation claw, and marks on the image by the separation claw were almost unnoticeable.

D: The paper sheet was separated from the heating roller by the separation claw, and marks by the separation claw were formed on the image, or the paper sheet: was wound around the heating roller and could not be separated from the heating roller.

TABLE 2

| | TONER NO. | MONOMER NO. | LOW-TEMPERATURE FIXABILITY MINIMUM FIXING TEMPERATURE (° C.) | HOT OFFSET RESISTANCE HOT OFFSET TEMPERATURE (° C.) | POST-FIXING SEPARABILITY |
|---|---|---|---|---|---|
| EXAMPLE 1 | 1 | A | 135 | NO HOT OFFSET | B |
| EXAMPLE 2 | 2 | B | 125 | NO HOT OFFSET | A |
| EXAMPLE 3 | 3 | C | 140 | NO HOT OFFSET | B |
| EXAMPLE 4 | 4 | D | 125 | NO HOT OFFSET | A |
| EXAMPLE 5 | 5 | E | 125 | NO HOT OFFSET | A |
| EXAMPLE 6 | 8 | F | 130 | NO HOT OFFSET | A |
| EXAMPLE 7 | 7 | G | 130 | NO HOT OFFSET | A |
| EXAMPLE 8 | 8 | H | 125 | 195 | B |
| EXAMPLE 9 | 9 | I | 125 | NO HOT OFFSET | B |
| EXAMPLE 10 | 10 | J | 135 | 195 | B |
| COMPARATIVE EXAMPLE 1 | 11 | K | 120 | 185 | B |
| COMPARATIVE EXAMPLE 2 | 12 | L | 110 | 180 | D |
| COMPARATIVE EXAMPLE 3 | 13 | M | 160 | NO HOT OFFSET | A |
| COMPARATIVE EXAMPLE 4 | 14 | B | 130 | 170 | D |

As can be seen from the above results, the toners [1] to [10] in Examples 1 to 10 had excellent low-temperature fixability and also had hot offset resistance and post-fixing separability.

The invention claimed is:

1. A toner for electrostatic image development, comprising toner particles containing a releasing agent and a binder resin, wherein the binder resin contains a copolymer including a structural unit derived from a monomer represented by the following general formula (1):

general formula (1)

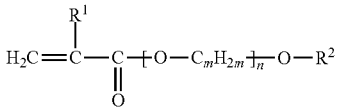

wherein $R^1$ represents a hydrogen atom or a methyl group, $R^2$ represents a methyl group or a phenyl group, m is an integer of 2 or 3, and n is an integer of 3 to 8.

2. The toner for electrostatic image development according to claim 1, wherein a content of the monomer represented by the general formula (1) is 2 to 12% by mass based on a total mass of monomers forming the copolymer making up the binder resin.

3. The toner for electrostatic image development according to claim 1, wherein m in the general formula (1) is an integer of 2.

4. The toner for electrostatic image development according to claim 1, wherein the copolymer making up the binder resin is a copolymer of the monomer represented by the general formula (1) and a vinyl-based monomer other than the monomer represented by the general formula (1).

5. The toner for electrostatic image development according to claim 1, wherein a content of the releasing agent in the toner particles is 1 to 30% by mass.

6. The toner for electrostatic image development according to claim 1, wherein the releasing agent comprises a hydrocarbon-based wax or an ester-based wax.

7. The toner for electrostatic image development according to claim 1, wherein the toner has a glass transition point of 30 to 50° C.

8. The toner for electrostatic image development according to claim 1, wherein the toner has a glass transition, point of 35 to 45° C.

9. The toner for electrostatic image development according to claim 1, wherein the binder resin has a weight average molecular weight (Mw) of 10,000 to 30,000.

10. The toner for electrostatic image development according to claim 1, wherein the binder resin has a weight average molecular weight (Mw) of 20,000 to 30,000.

11. The toner for electrostatic image development according to claim 1, wherein the releasing agent is a hydrocarbon-based wax or an ester-based wax.

* * * * *